US005285846A

United States Patent [19]

Mohn

[11] Patent Number: 5,285,846

[45] Date of Patent: Feb. 15, 1994

[54] THERMAL MINERAL EXTRACTION SYSTEM

[75] Inventor: Frank Mohn, London, England

[73] Assignee: Framo Developments (UK) Limited, London, England

[21] Appl. No.: 930,507

[22] PCT Filed: Mar. 27, 1991

[86] PCT No.: PCT/GB91/00464

§ 371 Date: Nov. 4, 1992

§ 102(e) Date: Nov. 4, 1992

[87] PCT Pub. No.: WO91/15654

PCT Pub. Date: Oct. 17, 1991

[30] Foreign Application Priority Data

Mar. 30, 1990 [GB] United Kingdom ..... 9007147

[51] Int. Cl.[5] ..... E21B 36/00

[52] U.S. Cl. ..... 166/61; 166/302

[58] Field of Search ..... 166/61, 57, 272, 302, 166/57, 60, 65.1, 67, 68

[56] References Cited

U.S. PATENT DOCUMENTS

| | | | |
|---|---|---|---|
| 1,876,627 | 9/1932 | Davis et al. . | |
| 2,754,912 | 7/1956 | Curson . | |
| 2,836,248 | 5/1958 | Covington | 166/61 |
| 3,187,814 | 6/1965 | McCarthy | 166/61 X |
| 3,420,302 | 1/1969 | Edwards . | |
| 4,019,575 | 4/1977 | Pisio et al. . | |
| 4,671,351 | 6/1987 | Rappe . | |
| 4,690,212 | 9/1987 | Termohlen . | |
| 4,790,375 | 12/1988 | Bridges et al. . | |
| 4,951,748 | 8/1990 | Gill et al. | 166/302 X |
| 5,040,605 | 8/1991 | Showalter | 166/61 X |
| 5,168,929 | 12/1992 | Galloway | 166/302 X |

*Primary Examiner*—Thuy M. Bui

*Attorney, Agent, or Firm*—Young & Thompson

[57] ABSTRACT

Material is thermally extracted from an underground formation with the aid of heat supplied by electrical resistance heaters (21) or by tubing (5, 6) serving as such, or by heated fluid conveyed downhole in pipes (12), which may serve as electrical conductors, or as resistance heaters, or which may be heated downhole. The fluid may be circulated upwardly after passage through a downhole pump unit where the fluid is suitable.

22 Claims, 2 Drawing Sheets

THERMAL MINERAL EXTRACTION SYSTEM

DESCRIPTION

This invention relates to the extraction of minerals, for example oil or sulphur, from underground formations.

When the viscosity of a well effluent being recovered or extracted from an underground formation falls, as because of decreasing temperature, the rate of production flow can be adversely affected, possibly to such an extent that production from the well becomes impractical or impossible. Furthermore, the well effluent tends to deposit solids, for example, paraffin or free sulphur in the flow piping and production equipment, so as to obstruct perhaps completely half production. When these conditions occur, it may be necessary to abandon the well or to maintain production only at the cost and trouble of employing heat treatment operations calculated to increase the temperature and thus lower the viscosity of the well effluent, so as to facilitate its flow and thus permit continued production.

For example, sulphur is commonly mined by injecting heated water into a sulphur bearing formation for the purpose of melting the sulphur and permitting it to flow to the surface. A special solvent can be injected into the well to increase the solubility of the sulphur and prevent the deposition of elemental sulphur, as this tends to form a hard, adherent scale which can eventually plug the well and also the associated surface production equipment.

Paraffin blockages can occur in the production of oil and one of the methods for treating this condition is to inject hot oil into the formation. Hot water, steam and heated gases may be injected similarly for re-starting production from petroleum bearing formations.

However, a definite limitation is experienced as to the depth at which formations can be treated with heated fluids, because of heat loss from the fluids as they flow downwardly from the surface to the formation to be heated. Because of this cooling effect, it is generally not considered feasible to produce sulphur by existing heat transfer methods at depths below about 460–610 m. (1500–2000 ft.). Similarly, efforts to treat oil bearing formations at depths greater than this range with heated fluids such as oil or gas are generally not considered economical. In general, such prior art heat treatment methods for the thermal extraction of oil or other minerals have been expensive, labour intensive and more or less complicated in operation. They are moreover often attended by an undesired contact between the injected heating fluid and the well effluent itself.

The present invention is accordingly concerned with the thermal recovery or extraction of oil, sulphur and other subsurface minerals by means which at least partially overcome the difficulties encountered with previous thermal and solvent injection recovery methods.

The invention accordingly provides a method of and apparatus for thermal extraction of minerals from an underground formation, in which heat is generated in and/or supplied to an assembly of spaced tubing extending downwardly from a surface installation into a well hole and arranged to guide the extracted mineral from the formation to the surface installation.

The apparatus of the invention can readily be constructed as a complete production system, providing all the facilities appropriate to such a system.

The tubing assembly can comprise electrical heating elements, which can have the form of tubular electrical conductors, extending lengthwise within the space between inner and outer tubing, or inner and outer tubing can be connected together at their lower ends or at an appropriate downhole position in series with an electric supply source so that heat is generated resistively in the tubing itself. Appropriate insulation is provided and in the second instance this can comprise a dielectric barrier fluid between the inner and outer tubing, which can be circulated through a downhole pump unit included in the apparatus where artificial lift is required for the mineral to be extracted.

The electrical heating elements can be constituted, additionally or instead, as one or more heating coils located around the tubing through which the well effluent flows and preferably supported on this tubing. Thus, where the well effluent flows inside inner or innermost tubing of the assembly, one or more heating coils can be wound around its exterior, with appropriate electrical insulation from the tubing, and advantageously with outer thermal insulation to promote heat flow inwardly to the effluent.

Alternatively, a barrier fluid can be fed downwardly and then circulated upwardly through the tubing assembly, the fluid being heated by a suitable heater in the surface installation and/or electrically during its passage downwardly within the assembly, as by contact with electrical resistance heaters, which can be constituted by one or more pipes within which the fluid is guided. The barrier fluid can again be circulated through a downhole pump unit, where it can exercise a cooling function because of the heat loss it will have experienced at the upper part of the tubing assembly.

The tubing assembly can conveniently comprise spaced concentric circular cross-section inner and outer tubing, of which the outer tubing can have load bearing and protective functions, whereas the inner tubing constitutes a production liner guiding the extracted well effluent upwardly to the surface installation. Barrier fluid can be conveyed between the inner and outer tubing, as by way of pipes, which may be electrically resistive heating pipes held between them by spacers. The heat supplied to and/or generated in the tubing assembly maintains the well effluent carried within it at an appropriate temperature and thermal insulation can be provided to enhance efficient operation. Thus, the outer tubing may carry a thermally insulating and/or an inert gas can be provided between at least the upper portion of the outer tubing and a well casing within which it is received.

Besides providing for a downhole heat supply, embodiments of the present invention can comprise production tubing assemblies which effectively afford the necessary mechanical connection between the wellhead or surface installation and downhole equipment as well as providing for the upward transfer of the well effluents or extracted minerals. Power supply to downhole equipment for example pump motors and/or monitoring systems can readily be incorporated in the assemblies of the invention, as well as means for establishing communication between such downhole equipment and the wellhead Means for the supply or circulation of barrier or protective fluid can be readily incorporated.

The invention thus provides a well heating capability, without the need for a carrier solvent system, together with other multifunction capabilities as regards fluid, power and signal transmission. All the apparatus elements necessary to these functions are integrated in a single unitary assembly which permits the use of standard wire line techniques, at least above the level of the pump.

The invention is further described below, by way of example, with reference to the accompanying drawings, in which.

Figure 1:
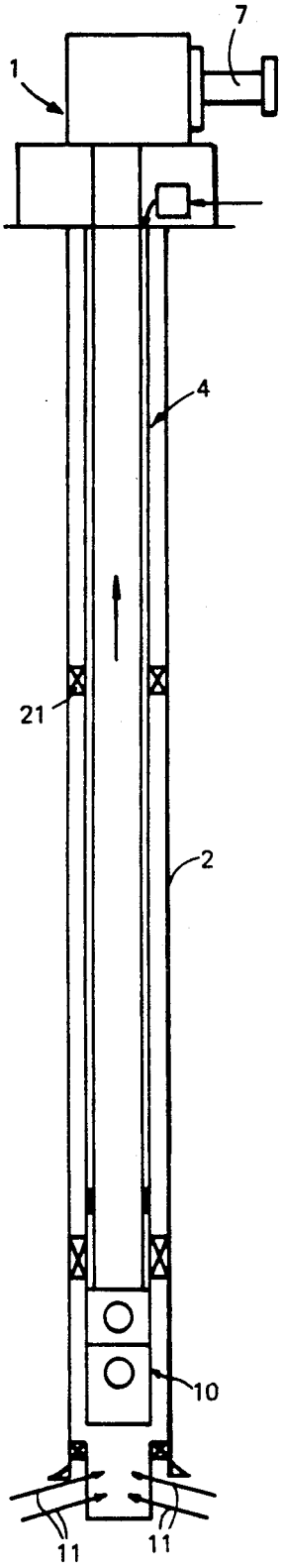
FIG. 1 is a schematic sectional side view of a thermal extraction system in accordance with the invention.

The system shown in FIG. 1 comprise a surface installation or wellhead 1 located above a well lined by a well casing 2. Suspended from the wellhead 1 to extend concentrically within the casing 2 is a tubing assembly 4 comprising outer tubing 5 functioning as an outer protection pipe and containing within it sub-assemblies to be described. The well casing 2 can conveniently be of 24.45 cm (9 ⅝ inches) outer diameter or more and the outer tubing 5 can suitably be of 17.78 cm (7 inches) outer diameter The material of the tubing 5 can be mild steel in relatively benign environments and the tubing may be provided externally with a coating to limit heat transfer outwardly from it.

Inner tubing in the form of a production liner 6 is received concentrically within the tubing 5. Because the outer tubing carries the main loads, the production liner 6 can be a relatively thin walled pipe of from 10.16–12.70 cm (4–5 inches) outer diameter. The liner 6 has of course to carry its own weight and to withstand pressure of the well effluent which it is its function to transfer to the surface installation for discharge by way of a discharge fitting 7. Titan would be a suitable material for the liner.

Figure 2:
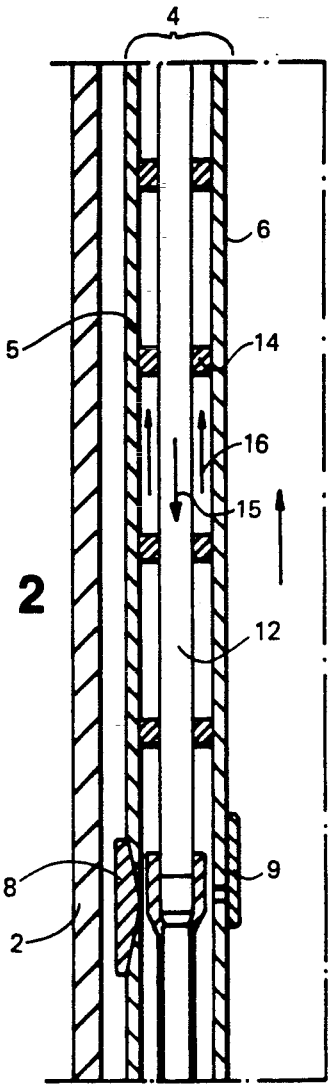
FIG. 2 is a half-sectional view on a larger scale of portions of the equipment of FIG. 1.
Figure 3:
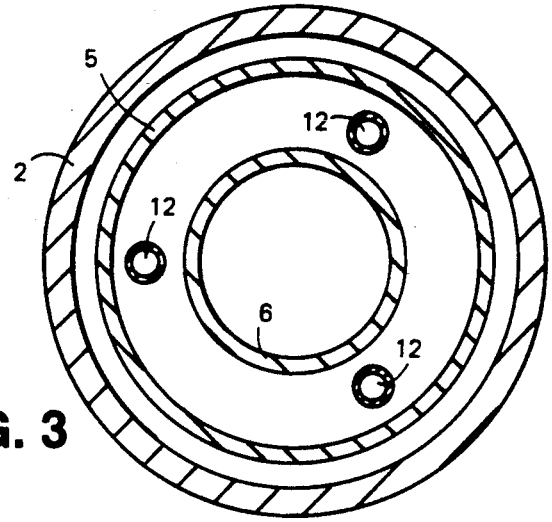
FIG. 3 is a crosssectional view, on the larger scale, of the equipment of FIG. 1.

As appears from FIG. 2, the tubing 5 comprises separate portions connected together in end-to-end relationship by collars 8 and the liner 6 comprises separate portions with ends arranged for "stab-in" connection, as indicated at 9, with an elastomer or metal-to-metal seal, or a seal combining both elastomer and metal-to-metal sealing engagement.

The tubing assembly 4 carries at its lower end an electrically driven pump unit 10 comprising an electric motor driving pump elements of appropriate configuration for moving the well effluent laterally into the lower end of the well casing and then upwardly internally of the liner 6 as indicated by arrows 11.

Three tubular electrical conductors or conductor pipes 12 are received within the annular space between the outer tubing 5 and the liner 6 at equally angularly spaced positions and are secured in place by spacers 14 which ensure electrical insulation between the pipes and the outer tubing and the liner.

The conductor pipes 12 supply electrical power from the wellhead 1 to the electric motor of the pump unit 10. They can also supply power to a downhole monitoring system and carry multiplexed signals between such a system and the wellhead. The interiors of the conductor pipes 12 serve for the supply of a barrier fluid, typically a protective oil, from the wellhead 1 to the pump unit 10 as indicated by arrows 15. The barrier fluid is returned upwardly from the pump unit 10 in the space between the outer tubing 5 and the liner 6 which is not occupied by the conductor pipes 12 as indicated by arrows 16. A local downhole circulation system at the pump unit 10 can provide for overpressure protection, seal leakage compensation, and cooling of the pump motor.

In addition, the conductor pipes 12 serve as a means for the supply of heat downhole. The barrier fluid is heated by a suitable heater 20 in the wellhead 1 before being pumped downwardly through the conductor pipes 12. In the upper part of the tubing assembly 4, heat travels from the conductor pipes 12 through the production liner 6 to heat the stream of effluent flowing within it. Where for example sulphur is being extracted, the deposition of free sulphur in the upper section of the liner 6, which typically occurs between 500–1500 meters below the surface is partly or totally prevented.

Efficient heat transfer is preferably ensured by filling the annular space between the well casing 2 and the outer tubing 5 with an inert gas, at least in the upper part of the well the lower limit of which is indicated by packing 21. Because the barrier fluid has lost heat as it travels downwardly, it is still able to operate as a cooling medium within the pump unit 10.

Although it is convenient to employ the conductor pipes 12 for the supply of electric power and if appropriate for electrical communication, as well as for conveying the heated barrier fluid, separate piping for the barrier fluid could be located between the outer tubing 5 and the production liner 6. Electrical power and communications could then be established by electrical conductors in the form of conventional insulated cable.

To minimise or avoid heat loss in the surface installation 1, at least part of the heat to be transferred to the interior of the liner 6 can be generated below the surface.

Figure 4:
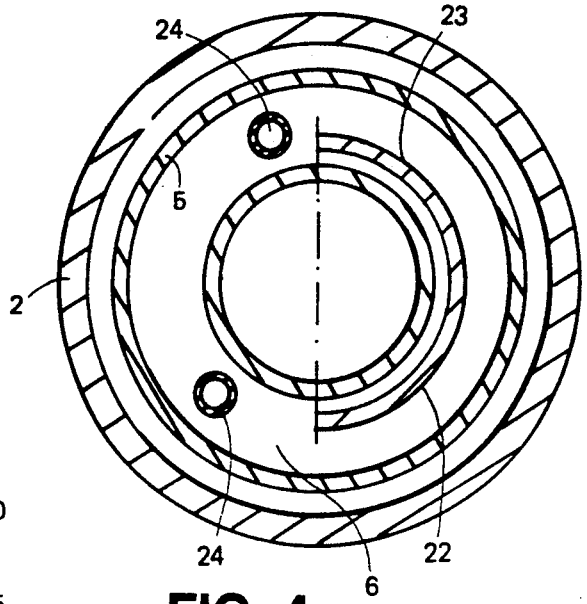
FIG. 4 is a view resembling that of FIG. 3 but showing at its left and right-hand sides respectively second and third thermal extraction systems embodying the invention.

Thus, the conductor pipes 12 can be employed as electrical resistance heaters. Additionally or instead, separate heating elements, not necessarily associated with barrier fluid, can be located between the tubing 5 and the liner 6. For example, three electrical 15 mm×2 mm heating tubes 24 can be located between the tubing and the liner, that is, at 20 mm radial spacing, as shown at the left-hand side of FIG. 4. An Iron-Chromium-Aluminium alloy having a specific resistivity of 500 m /m may be used as the resistor material. If a current of 300 Amp. is applied, the required surface voltage is less than 660 V and the arrangement will provide thermal energy or heat loss of 200 kW over a 1000 m depth of the well.

Additionally or instead, electrical heating coil means can be mounted on the liner 6, along the whole or part only of its length or at spaced positions along it. Thus as shown at the right-hand side of FIG. 4, an electrical heating coil 22 is placed around the production liner 6 and mechanically connected to it, the coil being suitably electrically insulated from the liner. Outwardly of the coil 22, a layer 23 of thermal insulation can be provided to assist inward heat transfer to the well effluent within the liner. The layer 23 preferably extends over the whole length of the coil 22 and if a plurality of spaced coils is used, the layer advantageously extends over the length or lengths of the liner 6 between them. Energization of the coil or coils 22 is effected by conductors extending along the assembly 4 from the well head 1, and if spaced coils are located on adjacent portions of the liner 6, electrical communication between the coils is achieved by contacts at the stab in joints 9.

Figure 6:
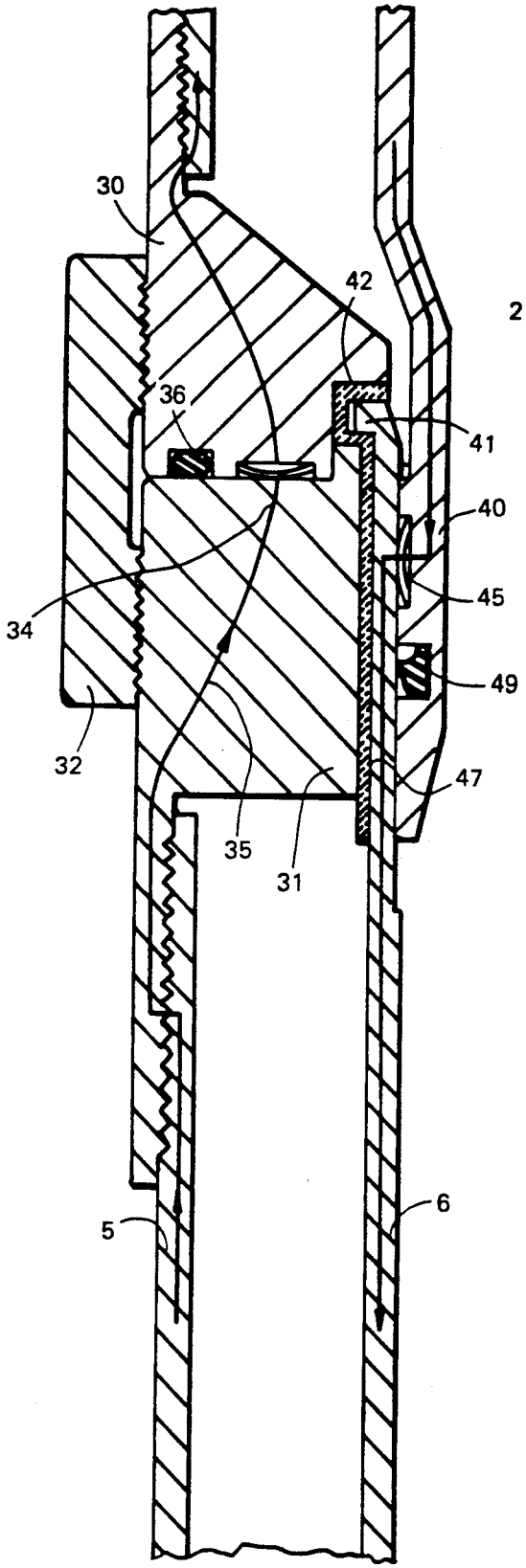
FIG. 6 is a fragmentary sectional side view on a larger scale of a portion of the system of FIG. 5.
Figure 5:
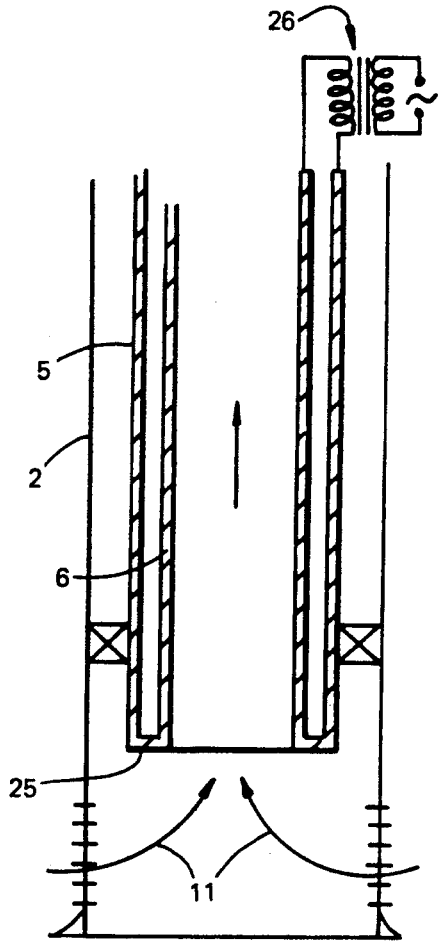
FIG. 5 is a schematic partial sectional side view of a fourth thermal extraction system in accordance With the invention.

Additionally or instead, as shown in FIGS. 5 and 6, the outer tubing 5 and the production liner 6 are electrically insulated from each other except for a low resistance coupling 25 at the lower end of the assembly 4, and are connected in series with an electric current source 26 at the surface installation Insulation between the tubing 5 and the liner 6, can be effected by the use of a dielectric barrier fluid, which may be circulated between them to a downhole pump unit if one is provided.

To ensure the necessary mechanical spacing between the tubing 5 and the liner 6, the jointing arrangement shown in FIG. 5 can be employed The ends of adjacent portions of the tubing 5 are received in respective joint fittings 30 & 31 and secured within them by screw-thread connections The end fitting are connected together by an external collar 32. A contact band in the form of an outwardly bowed annular strip 34 received in a groove in the upper fitting 30 ensures good electrical contact between the fittings along a current flow path 35. A seal element 36 also received in a groove in the fitting 30 extends around outside the contact strip 35 to effect a seal between the two portions of the tubing 5.

The two adjacent portions of the liner 6 at the joint are connected together by reception of a reduced diameter end 40 of one portion into the end of the other, which is provided with an external flange 41 received in a groove formed between the end fittings 30 and 31. A layer of insulation 42 is received between the fittings 30 and 31 and outer surface of the liner portion opposed to them. A contact band again in the form of an outwardly bowed strip 45 is received in an external groove of the reduced diameter end 40 to establish a low resistance current flow path 47 along the liner 6. An adjacent groove in the reduced diameter end 40 contains a seal element 49 sealing to the inner surface of the lower liner portion.

It will be evident that the invention can be embodied in a variety of ways other than as specifically illustrated and described.

I claim:

1. An apparatus for thermal extraction of material from an underground formation comprising:

a surface installation, production tubing extending downhole from said surface installation for guiding said material thereto from said underground formation, passage means receiving a heated fluid and extending along at least a portion of said production tubing and a heat source for heating said fluid, said heat source being located to extend along at least a portion of said production tubing.

2. The apparatus of claim 1 wherein said passage means comprises a plurality of pipes spaced around said production tubing.

3. The apparatus of claim 2 wherein said pipes function as electrical resistance heaters to constitute said heat source.

4. The apparatus of claim 2 further comprising an electrically energized downhole pump unit, and wherein said pipes function as electrical conductors for supplying electrical power to said pump unit.

5. The apparatus of claim 1 wherein said passage means provides for circulation of said fluid upwardly and downwardly along said production tubing.

6. The apparatus of claim 5 further comprising a downhole pump unit through which said fluid is circulated.

7. The apparatus of claim 1 wherein said heating source comprises electrical resistance heater means around said production tubing.

8. The apparatus of claim 7 further comprising thermal insulating means around said resistance heater means.

9. The apparatus of claim 7 wherein said electrical resistance heater means comprises plural elongate resistor elements spaced around said production tubing.

10. An apparatus for thermal extraction of material from an underground formation comprising:

a surface installation, production tubing extending downhole from said surface installation for guiding said material thereto from said underground formation, passage means for circulating a fluid along at least a portion of said production tubing, means for heating said circulating fluid, and a pump unit for circulating said heated fluid, said pump unit being located downhole.

11. The apparatus of claim 10 wherein said heating means is located downhole.

12. The apparatus of claim 11 wherein said heating means comprise electrical resistance heating means located around said production tubing.

13. The apparatus of claim 10 wherein said pump unit includes an electric motor and said passage means comprise electrically conductive piping supplying electric power to said motor.

14. An apparatus for thermal extraction of material from an underground formation comprising:

a surface installation, production tubing extending downhole from said surface installation for guiding said material thereto from said underground formation, and passage means containing a heated fluid extending along at least a portion of said production tubing for heating said material therein, said passage means functioning as electrical resistance heating means for heating said fluid.

15. The apparatus of claim 14 wherein said passage means comprises a plurality of pipes spaced around said production tubing.

16. The apparatus of claim 15 further comprising outer tubing around said production tubing, said plurality of pipes being received between said production tubing and said outer tubing.

17. The apparatus of claim 14 wherein said passage means is adapted to permit circulation of said heated fluid lengthwise of said production tubing.

18. An apparatus for thermal extraction of material from an underground formation comprising:

a surface installation, production tubing extending downhole from said surface installation for guiding said material thereto from said underground formation, piping containing a heated fluid extending along said production tubing for heating said material therein, and an electrically powered downhole pump for moving said material upwardly in said production tubing, wherein said piping functions an electrical conductor means for supplying electrical power to said downhole pump.

19. An apparatus for thermal extraction of material from an underground formation comprising:

a surface installation, electrically conductive production tubing extending downhole from said surface installation for guiding said material thereto from said underground formation, said production tubing comprising electrically conductive inner and outer tubing with said inner tubing within said outer tubing, means electrically connecting together said inner and outer tubing at a position downhole, and means located at said surface installation for connecting said inner and outer tubing with a source of electric current.

20. The apparatus of claim 19 further comprising barrier fluid providing insulation between said inner and said outer tubing.

21. The apparatus of claim 19 wherein said outer tubing and said inner tubing each comprise a plurality of sections connected together end-to-end and wherein said inner tubing connections between said sections by interfitting configurations, said configurations having electrical insulation therebetween.

22. The apparatus of claim 19 wherein said production tubing is received within a well casing and wherein an inert gas is held within at least the upper part of the space between said well casing and said production tubing.

* * * * *